United States Patent [19]

Alameda et al.

[11] Patent Number: 4,881,868

[45] Date of Patent: Nov. 21, 1989

[54] APPARATUS AND METHOD FOR RAPID TRANSPORT OF AN ELASTIC BAND

[75] Inventors: Daniel Alameda, Pacific Grove; Scott Cooper, Salinas, both of Calif.

[73] Assignee: Rubber Band Technology, Yakima, Wash.

[21] Appl. No.: 245,625

[22] Filed: Sep. 19, 1988

[51] Int. Cl.[4] ..... B25J 18/00

[52] U.S. Cl. ..... 414/773; 414/758; 414/772; 414/776; 414/744.7

[58] Field of Search ..... 414/773, 776, 758, 772, 414/783, 754, 744.2, 744.7, 27; 83/159, 925 EB; 53/295, 585

[56] References Cited

U.S. PATENT DOCUMENTS

| | | | |
|---|---|---|---|
| 2,823,816 | 2/1958 | Eddison | 414/744.7 X |
| 3,200,964 | 8/1965 | Eldred | 414/773 X |
| 3,877,569 | 4/1975 | Shields | 414/773 X |
| 4,060,015 | 11/1977 | Gros . | |
| 4,331,416 | 5/1982 | Berecz | 414/758 X |
| 4,570,415 | 2/1986 | Centano | 83/925 X |
| 4,579,027 | 4/1986 | Lewis . | |
| 4,674,270 | 6/1987 | Tonus . | |

*Primary Examiner*—Joseph J. Rolla
*Assistant Examiner*—Boris Milef
*Attorney, Agent, or Firm*—Flehr, Hohbach, Test, Albritton & Herbert

[57] ABSTRACT

An apparatus (21) and method for rapid transport of elastic bands (34) from a band loading station (22) to a band unloading station (23). The apparatus (21) includes a movable arm assembly (24) having a finger (26) thereon dimensioned to loosely receive an elastic band (34) therearound. A drive assembly (36) is coupled to move the arm assembly (24) from the loading (22) to the unloading station (23). The arm assembly (24) is further movable by the drive assembly (36) from a first orientation of the finger (26) to a second orientation of the finger (26) to enable gravity assisted mounting of the band (34) on the finger (26) at the loading station (22) and gravity assisted demounting of the band (34) at the unloading station (23). During the transport of the band (34) between the loading (22) and unloading stations (23), the finger (26) is reoriented along a path maintaining the band (34) on the finger (26) against dynamic forces acting on the band (34) during transport of the arm assembly (24). The apparatus (21) includes a gear train (43, 44, 53, 62) which simultaneously pivots the arm assembly (24) between the loading (22) and unloading station (23) while it rotates the arm (24) in a direction opposed to the pivoting to maintain the band (34) on the finger (26) during pivoting of the arm (24).

17 Claims, 3 Drawing Sheets

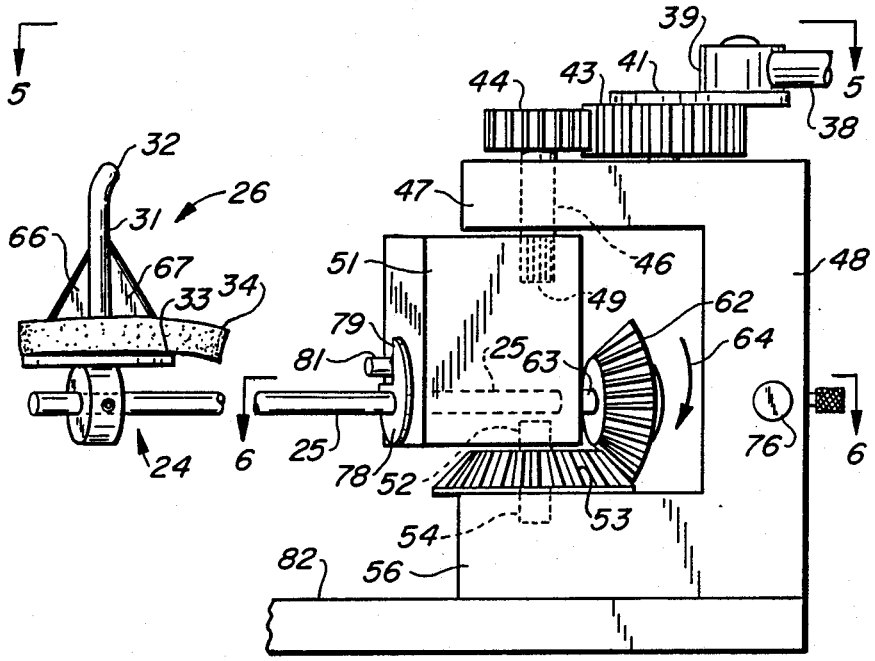
FIG._4.
FIG._5.
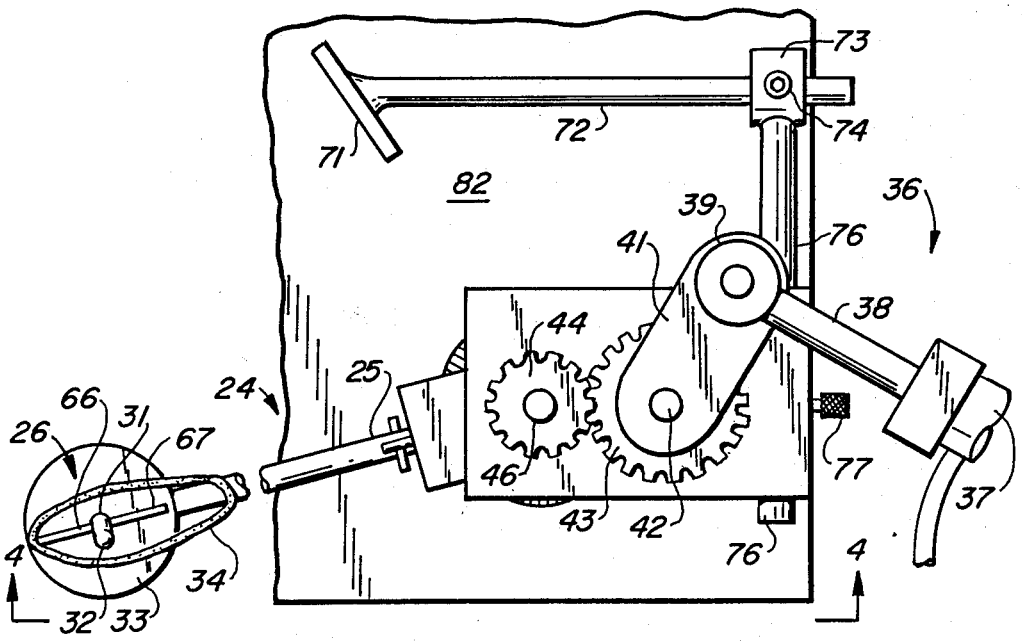

APPARATUS AND METHOD FOR RAPID TRANSPORT OF AN ELASTIC BAND

TECHNICAL FIELD

The present invention relates, in general, to the transport of a band of elastic material from a source of bands to a device for manipulation of the bands, and more particularly, relates to an apparatus for transporting elastic bands from a band cutter or similar source to an apparatus for manipulating the elastic band, for example, by expanding and applying

BACKGROUND ART

Considerable attention has been given to the development of apparatus for cutting elastic bands from tubular band stock and further for the application of cut elastic bands to various objects ranging from broccoli to stacks of envelopes. While it is possible in some installations to provide elastic band cutting apparatus which deposits the cut bands directly on the elastic band manipulating apparatus, in some applications such an arrangement is not possible or desirable. Moreover, there are many installations in which cut elastic bands are provided in bulk, which installations require the provision of apparatus for picking individual bands out of the bulk source of cut elastic bands. Once picked up by the band picking apparatus, the individually segregated bands must be transported from the band picker to the band expanding or manipulating apparatus.

Since band expanding and applying apparatus can operate at relatively high speed, and since band cutters similarly can operate at very high speed, it is important that any band transporting device must be capable of rapid cycling so that it does not become the bottleneck which limits overall system operation. The requirement for rapid operation, in turn, produces significant dynamic forces on the rubber band as it is transported between a band loading station proximate the source of bands to a band unloading station proximate the band manipulating apparatus.

Typical of apparatus suitable for cutting rubber bands from a continuous sheet of tubing are the devices disclosed in U.S. Pat. No. 4,579,027 to Lewis and U.S. Pat. No. 4,060,015 to Gros. The Gros patent further includes a band transport assembly in which a pair of tensioning fingers are inserted into the tubing and used to transport the cut band from the cutter to a band delivery position for further manipulation. The transport fingers in the patent to Gros control the orientation and path of the band during the dynamics of transport by placing the band under tension on the transport fingers.

U.S. Pat. No. 4,674,270 to Tonus also discloses a rubber band cutting assembly which has a transport arm with snagging pins that pierce the elastic band as it is cut from the band tubing. The cut bands are forced onto the snagging pins where they are held by the pins during rotation of the cut band to band expanding arms. Thus, the band is controlled during the dynamics of the transport process by impaling the band on diverging snagging pins.

Additionally, elastic band pick up assemblies have been devised which will pick up individual elastic bands from a bin having a plurality of cut bands in random orientations. The pick up device, in effect, combs through and segregates bands until it finally picks up an individual band on a finger and conveys the same to an unloading station proximate a band manipulating assembly, such as a band expander. Such pickup devices usually depend upon the use of a plurality of fingers in a conveyor which moves relatively slowly, with the number of fingers helping to reduce the cycle time at which bands reach the band expander. The band is maintained on the pick up fingers by gravity during the transport process.

Such prior elastic band transport apparatus have been found to have certain disadvantages. Systems which depend upon controlling the band by expanding the same, for example, the device in the patent to Gros, require a somewhat tedious insertion of the fingers into the band and expansion step to produce gripping of the band. These types of manipulations tend to slow cycling and complicate the required apparatus. The Tonus approach of piercing the band to secure the same on snagging pins has the disadvantage of not being well suited for use with thin bands. The piercing step endangers the integrity of thinner bands and can become impossible to use. The gravity support approach is usually applicable when the transport speeds are not very high and requires the use of multiple conveying fingers to try to increase the cycling rate.

Accordingly, it is an object of the present invention to provide an apparatus and method for rapid transport of cut elastic bands from a band loading station to a band unloading station which is suitable for use in a wide variety of applications.

Another object of the present invention is to provide an apparatus for the rapid transport of elastic bands which does not require gripping or expansion of the bands during the transport process.

Still a further object of the present invention is to provide an apparatus and method for the transport of elastic bands between a source of bands and band manipulating apparatus which is suitable for use with elastic bands of any width.

Still another object of the present invention is to provide an apparatus and method for rapid transport of elastic bands between a band cutting assembly and a band expanding assembly which is durable, reliable and simple in its construction and operation.

The elastic band transport apparatus and method of the present invention have other objects and features of advantage which will become apparent from and are described in more detail in the following description of the Best Mode Of Carrying Out The Invention and the accompanying drawing.

DISCLOSURE OF INVENTION

The apparatus for rapid transport of elastic bands of the present invention comprises, briefly, a movable arm assembly having a finger thereon dimensioned to loosely receive the elastic band therearound; a drive assembly coupled to rapidly move the arm assembly from a band loading station to a relatively spaced apart band unloading station, the arm assembly being further movable by the drive assemby from first orientation, for gravity assisted mounting of the band on the finger at the loading station, to a second orientation, for gravity assisted demounting of the band from the finger at the unloading station; and the arm assembly being driven by the drive assembly between the first and second orientations along a path maintaining the band on the finger against dynamic forces acting on the band during transport of the band and reorientation of the finger. More particularly, the arm is preferably pivoted about a vertical axis to transport the band while the arm is simultaneously rotated in a reverse direction about a horizontal axis to reorient the finger for gravity assisted unloading of the band from the finger.

The method of transporting an elastic band of the present invention comprises, briefly, the steps of mounting the band loosely around a movable finger with the finger oriented for gravity maintenance of the band thereon, moving the finger from a loading station to an unloading station, reorienting the finger during the moving step for gravity demounting of the band at the unloading station, and during the reorienting step, employing motion of the finger during the reorienting step to maintain the band on the finger against dynamic forces on the band during the moving step until the finger reaches the unloading station and is reoriented for gravity demounting of the band.

BRIEF DESCRIPTION OF THE DRAWING

FIG. 4 is an enlarged, fragmentary, side elevation view taken substantially along the plane of line 4—4 in FIG. 1.

FIG. 5 is a top plan, fragmentary view, taken substantially along the plane of line 5—5 in FIG. 4.

BEST MODE OF CARRYING OUT THE INVENTION

Figure 1:
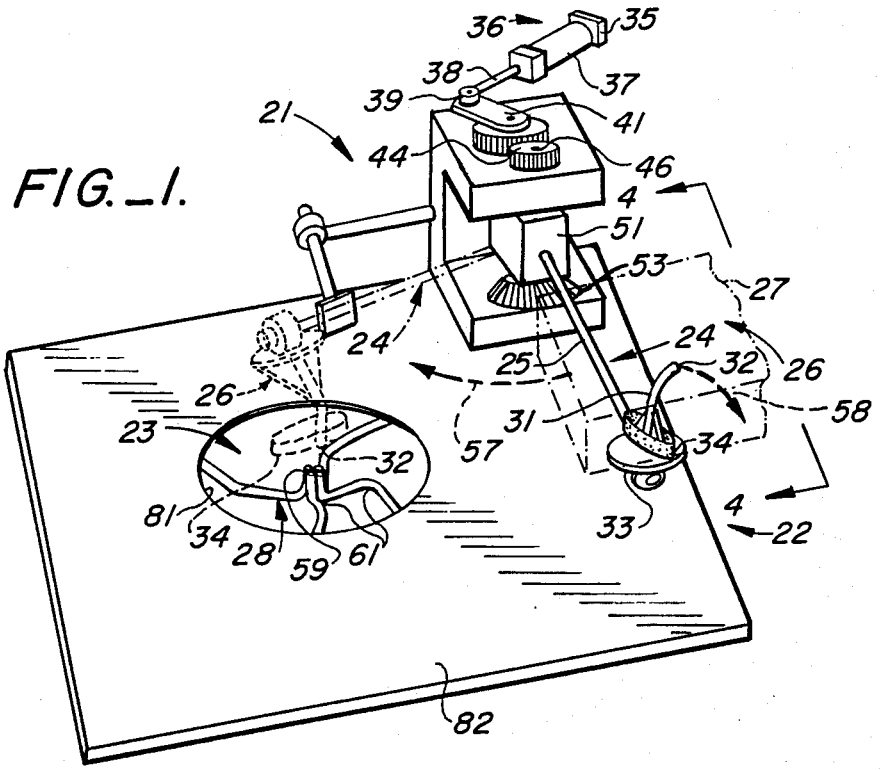
FIG. 1 is a top perspective view of an elastic band transport apparatus constructed in accordance with the present invention.
Figure 6:
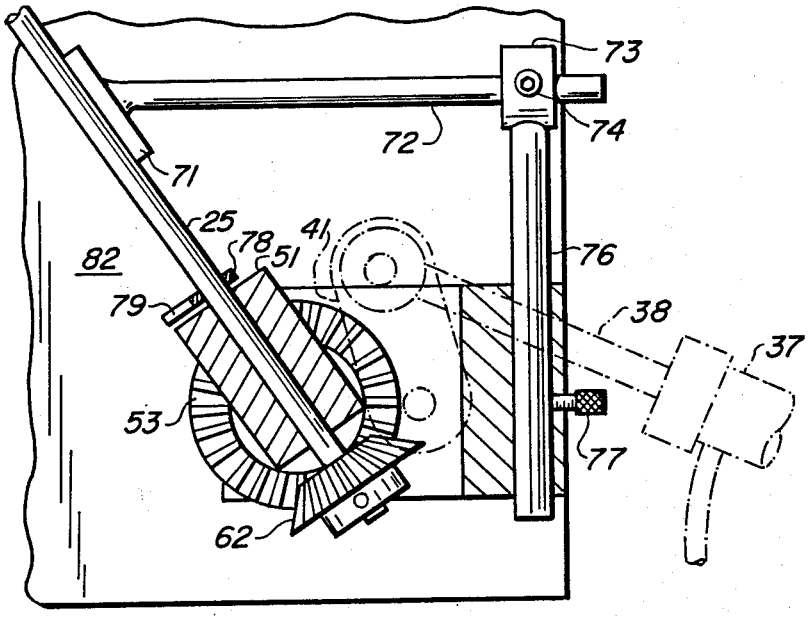
FIG. 6 is a top plan view, partially in cross section, taken substantially along the plane of line 6—6 of FIG. 4 with the transport arm in a moved position.

Instead of attempting to transport an elastic band by either stretching it between band manipulating fingers or impaling it on snagging pins, the transport assembly of the present invention employs an approach in which the gravity force and the motion of the arm are used to maintain the band on the transport arm until it is unloaded at the unloading station. FIG. 1 illustrates an elastic band transport assembly, generally designated 21, which is formed to transport elastic bands from a loading station, generally designated 22, to an unloading station, generally designated 23. Transport of elastic bands is accomplished by means of a movable arm assembly, generally designated 24, having finger means 26 carried thereon. In the assembly shown in FIG. 1 band loading station 22 is positioned under an elastic band cutting apparatus 27, while band unloading station 23 is positioned over an elastic band expanding assembly 28. As will be understood, however, the apparatus of the present invention can be employed to transport elastic bands between loading and unloading stations at which different operations are being performed.

In order to eliminate the need to either grip or pierce the band at loading station 22, the transport assembly of the present invention includes finger means 26 which is dimensioned to loosely receive the elastic band therearound and is oriented in a first orientation at loading station 22 for gravity assisted mounting and support of the band on the finger. Thus, finger 26 can be seen to be comprised of a vertically oriented rod-like member 31 having a distal end 32 and a support surface or platform 33 extending laterally from member 31 at a spaced distance from end 32, namely, at the lower end or proximal of the finger. Surface 33 is oriented in a plane substantially perpendicular to member 31, and at loading station 22 the support surface or platform 33 is in a substantially horizontal plane for gravity assisted support of elastic band 34 thereon.

The rapid elastic band transport apparatus 21 of the present invention further includes drive means, generally designated 36, coupled to move arm assembly 24 from band loading station 22 to relatively spaced apart band unloading station 23. In the preferred form shown in FIG. 1, drive means 36 includes a pneumatic cylinder 37 with a piston 38, which is pivotally coupled at coupling 39 to arm 41. The base 35 of cylinder 36 also preferably is pivotally mounted to a frame member (not shown) so that pivoting of arm 41 does not result in binding of the piston and cylinder.

Arm 41 is keyed to a shaft 42 (FIG. 5) which also carries gear 43 secured for rotation with shaft 42. Rotatably mounted proximate gear 43 is a second gear 44, which is keyed to shaft 46 that in turn is rotatably mounted in the upper leg 47 of C-shaped frame member 48. Lower end 49 of shaft 46 is keyed to an arm hub means or arm block member 51 so as to produce rotation of block member 51 with shaft 46. A second fixed shaft 52 extends up into a lower side of arm block member 51 which slidably receives shaft 52 for pivoting of hub 51 therearound. As thus far described, therefore, extension of piston 38 will produce rotation of gears 43 and 44, which, in turn, causes rotation of arm block member 51. Such rotation results in movement, in this case pivotal movement, of arm assembly 24 about the aligned longitudinal axes of shaft 46 and shaft 52, hereinafter the transport axis, as indicated by arrow 57 in FIGS. 1 and 2A. Such pivotal movement can be very rapid and will effect high-speed displacement of finger means 26 and elastic band 34 from the band loading station to the band unloading station.

Additionally, in the elastic band transport apparatus of the present invention, arm assembly 24 is movable by drive means 36 from a first orientation, (solid lines in FIG. 1) at band loading station 22, to a second orientation of finger means 26 (broken lines in FIG. 1) for gravity assisted demounting of band 34 at unloading station 23. Moreover and very importantly, arm assembly 24 is driven by drive means 36 between the first and second orientations along a path maintaining band 34 on finger means 26 against dynamic forces acting on the band during transport and reorientation of the finger.

Such reorientation of the finger while maintaining the band on the finger during transport is accomplished by imparting momentum to the band having a component opposed to the direction of momentum imparted to the band during movement between the loading and unloading stations. More particularly, finger means 26 is rotated about the central longitudinal axis OF ARM MEMBER 25 (the orientation axis) in a direction opposed to the direction of rotation about the shafts 46 and 52 (the transport axis), as indicated by arrow 58 in FIGS. 1 and 3.

When arm assembly 24 reaches the unloading station, therefore, finger means 26 can be seen to be reoriented with the distal end 32 at a position below a horizontal plane through arm member 25 for gravity assisted demounting of band 34 onto the distal ends 59 of band expanding arms 61 positioned at the unloading station. The distal end 32 of finger 31 is sloped downwardly from the horizontal (at the unloading station) to assist in gravity unloading of the bands onto ends 59 of the band expanding arms.

The simultaneous transport about the transport axis and reorientation about the reorientation axis of arm assembly 24 is accomplished by mounting a bevel gear 62 on the end 63 of arm member 25. The arm member 25 is rotatably mounted inside block 51 and bevel gear 62 is keyed to arm member 25 and matingly engaged with a stationary horizontal bevel gear 53 mounted on stationary shaft 52. As block or hub member 51 is rotated about the transport axis, namely, shafts 46 and 52, bevel gear 62 walks around fixed bevel gear 53. The rotation of block 51, therefore, produces a rotation of bevel gear 62 in a direction, as indicated by arrow 64 in FIG. 4. This, in turn, rotates the entire arm 25 with finger means 26 from the solid line position of FIG. 1 to the dotted line position in FIG. 1.

During the rapid transport of the band from the band loading station 22, therefore, to the band unloading station 23, the simultaneous reverse rotation of finger means 26 maintains the band on the finger until arm 25 stops, at which point the band is also reoriented and gravity demounting of the band occurs.

As will be appreciated, as the transport rate or rotation of arm 24 about the transport axis increases, there is considerable centrifugal force on the band. In order to prevent spinning of the band about the rod-like finger 31, it is further preferable that finger means 26 include means resisting rotation of the band on the finger during movement of the arm assembly. Such means can be provided by plate-like triangular members 66 and 67, which extend away from opposite sides of rod-like finger member 31 in a common plane and slope from the finger downwardly and outwardly to support surface 31. Since bands 34 are preferably cut from tubing 68 (FIGS. 2A, 3 and 3A) which has been flattened during the tubing forming and handling process, the bands cut therefrom are usually elongated in a direction corresponding to the flattening of the tubing. Such elongation can be seen in FIG. 5, for example. Triangular members 66 and 67 are most preferably oriented in general alignment with the elongated orientation which the cut bands will typically assume from cutter 27.

While the stroke of actuator drive means 36 can be used to control the pivoting of arm assembly 24, it is preferable to provide stop means 71 mounted to an arm 72, which can be adjusted at coupling 73, to enhance the precision of the position which the finger is stopped over the band manipulating arms 61. Adjustment of stop 71 can be accomplished by selective locking of either or both of arms 72, by set screw 74 or arm 76 by set screw 77. As will be appreciated, a similar adjustable stop (not shown) may be provided at the band loading station so that the finger is precisely positioned relative to the band cutting assembly 27.

Since the bevel gears also have a certain amount of imprecision in their meshing, it is further preferable if arm member 25 carries a plate-like member 78 for rotation therewith. The edge 79 of plate 78 will engage a stop member 81 provided on arm block 51 to thereby precisely control the vertical positioning of finger 26 at the loading station 22.

While the apparatus of the present invention is shown as employed to transport elastic bands from a cutter 27 to an elastic band expander 28, it will be understood that the same transport assembly 21 can be employed in connection with other band supply means at loading station 22 and other band manipulating means at unloading station 23. For example, instead of cutting bands directly onto finger means 26, a device for picking up ends from a source of randomly oriented bands is well known in the industry. Such band pickers can deposit bands onto finger 26 at band loading station 22. Similarly, the apparatus of the present invention is shown with band expanding arms 61 which are positioned beneath an opening 81 in a plate member 82. Numerous band expanders with and without platforms or plates 82 are well known in the art.

OPERATION

Figure 2A:
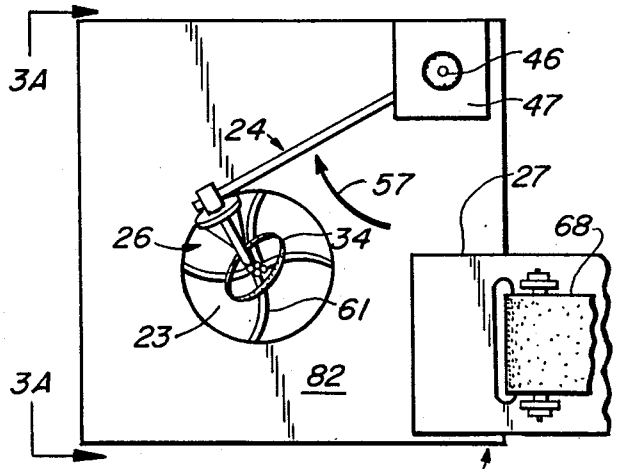
FIG. 2A is a top plan view corresponding to FIG. 2 taken substantially along the plane of line 2A—2A of FIG. 3A, with the transport arm in a moved position.
Figure 3A:
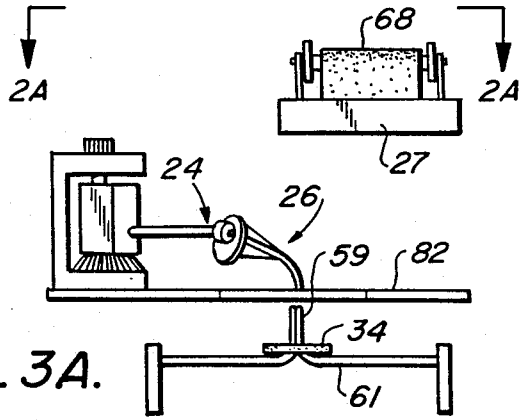
FIG. 3A is a side elevation view taken substantially along the plane of line 3A—3A in FIG. 2A.
Figure 2:
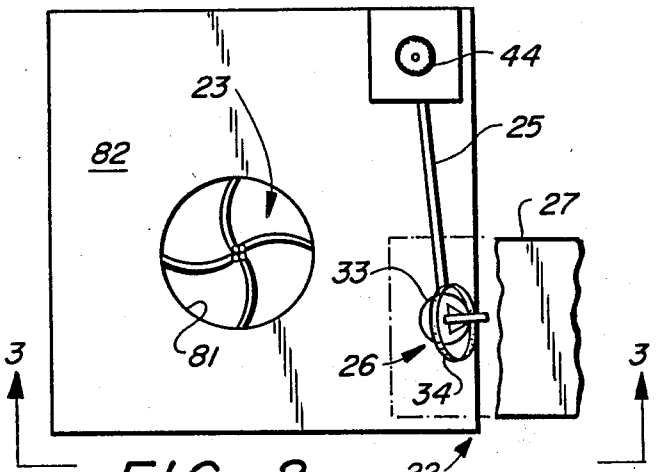
FIG. 2 is a top plan schematic representation of the apparatus of FIG. 1 in reduced scale.
Figure 3:
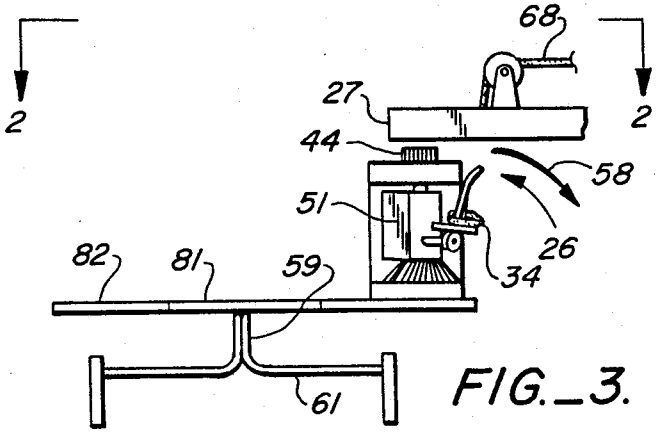
FIG. 3 is a side elevation view taken substantially along the plane of line 3—3 in FIG. 2.

Having described the apparatus of the present invention, operation of the same and the method of transporting elastic bands of the present invention can be described. FIGS. 2, 2A, 3 and 3A illustrate the transport of an elastic band using transport assembly 21. The method of the present invention includes mounting band 34 loosely around movable finger means 26 with finger means 26 oriented for gravity maintenance of the band thereon. This step is illustrated in FIGS. 2 and 3 with band 34 being gravity deposited from band cutting apparatus 27 onto the nearly vertically oriented finger means 26. Next, the method of the present invention includes the step of moving finger 26 from band loading station 22 to band unloading station 23, preferably by pivoting the finger about a transport axis or shafts 46 and 52, as indicated by arrow 57 in FIG. 2A. During the moving step, the method of the present invention includes the step of reorienting finger means 26 for gravity demounting of band 34 at unloading station 23. Such reorientation of the finger is shown in FIGS. 2A and 3A.

Finally, during the reorienting step, the method of the present invention includes the step of employing the motion of finger 26 during the reorienting step to maintain band 34 on the finger against dynamic forces on the band from the moving step. Thus, the band is rotated as indicated by arrow 58 in FIG. 3 in a direction opposite to the direction of transport so that the dynamic forces during acceleration, transport and deceleration do not project or throw the band off the finger.

It should be noted that when arm assembly 24 stops at the band unloading station, there will be considerable inertia in the band, which will initially urge the band toward support platform 33. Once the arm motion has been completely stopped, however, the band will then drop under the influence of gravity to the position shown in FIG. 3A over the ends 59 of band expanding arms 61.

Once band 34 has been deposited on arms 61, actuator 37 will return arm 24 to the band loading station 22 for the next band. Using the apparatus of the present invention, it has been found possible to transport bands at a rate of 25 to 30 bands per minute between band cutter 27 and band expander 23 separated by about 8 inches. Such high-speed operation enables the band cutter and band expander to be run at higher rates than had heretofore been possible. The transport mechanism of the present invention, therefore, reduces the problem of the transport device acting as a bottleneck in the process of transporting cut bands to band manipulating equipment.

What i s claimed is:

1. An apparatus for rapid transport of an elastic band comprising:

a movable arm assembly having finger means thereon dimensioned to loosely receive said band therearound;

drive means coupled to move said arm assembly from a band loading station to a relatively spaced apart band unloading station;

said arm assembly further being movable by said drive means from a first orientation of said finger means for gravity assisted mounting and support of said band on said finger means at said loading station to a second orientation of said finger means for gravity assisted demounting of said band therefrom at said unloading station; and said arm assembly being driven by said drive means between said first orientation and said second orientation along a path maintaining said band on said finger means against dynamic forces acting on said band during acceleration, transport and deceleration of said band and reorientation of said finger means.

2. The apparatus as defined in claim 1 wherein, said arm assembly is movable from said first orientation to said second orientation along a reorientation path imparting momentum to said band having a component opposed to the direction of momentum imparted to said band during movement of said arm assembly from said loading station to said unloading station.

3. The apparatus as defined in claim 1 wherein, said arm assembly is mounted for pivotal movement about a transport axis and said finger means is mounted for pivotal movement about an orientation axis substantially perpendicular to said transport axis.

4. The apparatus as defined in claim 1 wherein, said arm assembly is mounted for pivotal movement about a substantially vertical oriented axis to effect transport of said band from said loading station to said unloading station; and said arm assembly is further mounted for pivotal movement of said finger means about a substantially horizontally oriented axis during pivotal movement about said vertically oriented axis.

5. The apparatus as defined in claim 4 wherein, said arm assembly is mounted for pivotal movement of said finger means about said horizontally oriented axis in a direction opposed to the direction of pivoting of said arm assembly about said vertically oriented axis.

6. The apparatus as defined in claim 4 wherein, said arm assembly is mounted for pivoting of said finger means between a near vertical position at said loading station to a position rotated below a horizontal plane through said arm assembly at said unloading station.

7. The apparatus as defined in claim 1 wherein, said finger means includes a rod-like member having a distal end and a support surface extending laterally from said rod-like member at a spaced distance from said distal end, said support surface being oriented in a plane substantially perpendicular to said rod-like member.

8. The apparatus as defined in claim 7 wherein, said rod-like member is vertically oriented, and said distal end is sloped downwardly from the horizontal when positioned at said unloading station.

9. The apparatus as defined in claim 7 wherein, said finger means includes a means resisting rotation of said band on said finger means during movement of said arm assembly, said means resisting rotation being mounted proximate said support surface.

10. The apparatus as defined in claim 9 wherein, said means resisting rotation is provided by triangular plate-like members extending away from opposite sides of said rod-like member in a common plane and sloping from said finger downwardly and outwardly to said support surface.

11. The apparatus as defined in claim 1 wherein, said arm assembly includes a central hub means mounted for pivotal movement about a vertical axis and an arm member extending radially from said hub means and mounted to said hub means for pivotal movement about a horizontal axis, said finger means is provided by a finger carried by said arm member at a spaced distance from said hub means, and said arm assembly includes gear means coupled to rotate said arm about said horizontal axis as said hub means rotates about said vertical axis.

12. The apparatus as defined in claim 11 wherein, said drive means is coupled to rotate said hub means, and said gear means produces rotation of said arm in response to rotation of said hub means.

13. The apparatus as defined in claim 12 wherein said gear means includes a stationary bevel gear mounted proximate said hub means and a mating bevel gear carried by said arm member.

14. A method of transporting an elastic band between a band loading station and a band unloading station comprising the steps of:

(a) mounting said band loosely around movable finger means, with said finger means oriented for gravity maintenance of said band means thereon;

(b) moving said finger means from said loading station to said unloading station;

(c) during said moving step, reorienting said finger means for gravity demounting of said band at said unloading station; and (d) during said reorienting step, employing the motion of said finger means during said reorienting step to maintain said band on said finger means against dynamic forces on said band from said moving step until said finger means reaches said unloading station and is reoriented for gravity demounting of said band.

15. The method as defined in claim 14 wherein, said mounting step is accomplished by mounting said band on said finger means while said finger means is in a substantially vertical orientation with a distal end of said finger means facing in an upward direction; and said reorienting step is accomplished by rotating said finger means in a direction opposed to the direction of movement of said finger during said moving step.

16. The method as defined in claim 15 wherein, said finger means is mounted on an arm and said moving step is accomplished by pivoting said arm about a first axis during said moving step, and said reorienting step is accomplished by rotating said finger means about a second axis perpendicular to said first axis during said reorienting step.

17. The method as defined in claim 14 wherein, said mounting step is accomplished by positioning said finger means to receive said band thereover from band cutting means, and said reorienting step is accomplished by positioning said finger for demounting of said band onto band expanding means.

* * * * *

UNITED STATES PATENT AND TRADEMARK OFFICE

CERTIFICATE OF CORRECTION

PATENT NO. : 4,881,868

DATED : November 21, 1989

INVENTOR(S) : Daniel Alameda and Scott Cooper

It is certified that error appears in the above-identified patent and that said Letters Patent is hereby corrected as shown below:

Column 1, line 12, after "applying" insert ---the same to an object.---.

Signed and Sealed this

Eighteenth Day of September, 1990

*Attest:*

HARRY F. MANBECK, JR.

*Attesting Officer*

*Commissioner of Patents and Trademarks*